United States Patent [19]

Teman

[11] 4,396,244

[45] Aug. 2, 1983

[54] SOLDERLESS CONNECTOR DEVICE

[75] Inventor: Zale E. Teman, Redwood City, Calif.

[73] Assignee: Raychem Corporation, Menlo Park, Calif.

[21] Appl. No.: 255,949

[22] Filed: Apr. 20, 1981

[51] Int. Cl.[3] ..... H01R 9/09

[52] U.S. Cl. ..... 339/19; 339/17 C; 339/177 R; 339/DIG. 1

[58] Field of Search ..... 339/17 R, 17 C, 177 R, 339/177 E, 278 R, 278 T, 278 M, DIG. 1, 95 R, 19

[56] References Cited

U.S. PATENT DOCUMENTS

| | | | |
|---|---|---|---|
| 1,362,992 | 12/1920 | Haywood et al. | 339/177 E |
| 1,686,347 | 10/1928 | Scheuermann | 339/177 E |
| 2,919,421 | 12/1959 | Modrey | 339/177 E |
| 3,858,956 | 1/1975 | Garrett | 339/95 R |

OTHER PUBLICATIONS

BM Bulletin, Birnstill, vol. 17, No. 12, p. 3658, 5-1975.

*Primary Examiner*—Neil Abrams
*Attorney, Agent, or Firm*—Herbert G. Burkard

[57] ABSTRACT

A solderless connector device for engaging pins which are symetrically arranged in a grid network on a printed wiring board (hereinafter P.W. board). The P.W. board includes a center pin and surrounding pins which are symetrically arranged around each center pin. The device has an opening running from the top to the bottom and a first end having an annular pins engagement means for spreading apart the surrounding pins about the center pin, creating and maintaining a gas-tight intimate seal between the surrounding pins and the body, and fierecely gripping the surrounding pins for discouraging removal of the body from the P.W. board.

4 Claims, 4 Drawing Figures

SOLDERLESS CONNECTOR DEVICE

BACKGROUND OF THE INVENTION

In the past it has been desirable to connect an electrically conductive lead wire to a printed wiring board, (hereinafter P.W. board). Pins were arranged symetrically in the P.W. board and the electrical lead terminated at an electrical connection device. The terminating device could then be pushed into place in the P.W. board with the use of additional solder type connectors. Users of these devices have sometimes found that solder devices may be inconvenient to work with in certain circumstances.

Applicant has developed a solderless connector device which creates and maintains a gas-tight intimate seal between an electrical lead and P.W. board pins.

DESCRIPTION OF THE INVENTION

Summary of the Invention

A connector device for engaging pins arranged in a grid on a P.W. board, the P.W. board having center and surrounding pins, the surrounding pins arranged symetrically about the center pin, the device comprising a turret-like body having a first end and a second end and an opening extending through the first end to the second end, the opening in the first end configured for surrounding and isolating a center pin and the first end including an annular pins engagement means for spreading apart the surrounding pins about the center pin, creating and maintaining a gas-tight intimate seal between the surrounding pins and the body and fiercely gripping the surrounding pins for discouraging removal of the device.

Objects of the Invention

It is a primary object of this invention to provide a solderless connection device which is useful in completing a connection of an electrical lead to a P.W. board.

It is another object of this invention to provide a solderless connection device which is useful in providing good electrical contact between a coaxial cable or other shielded cable connector and P.W. board pins.

It is another object of this invention to provide a solderless connection device which enables a user to terminate a shielded cable with connector at a P.W. board with a minimal loss of shielding.

Other objects and advantages of the invention will become apparent with reference to the accompanying description of the drawing.

IN THE DRAWING

DETAILED DESCRIPTION OF THE INVENTION

Figure 1:
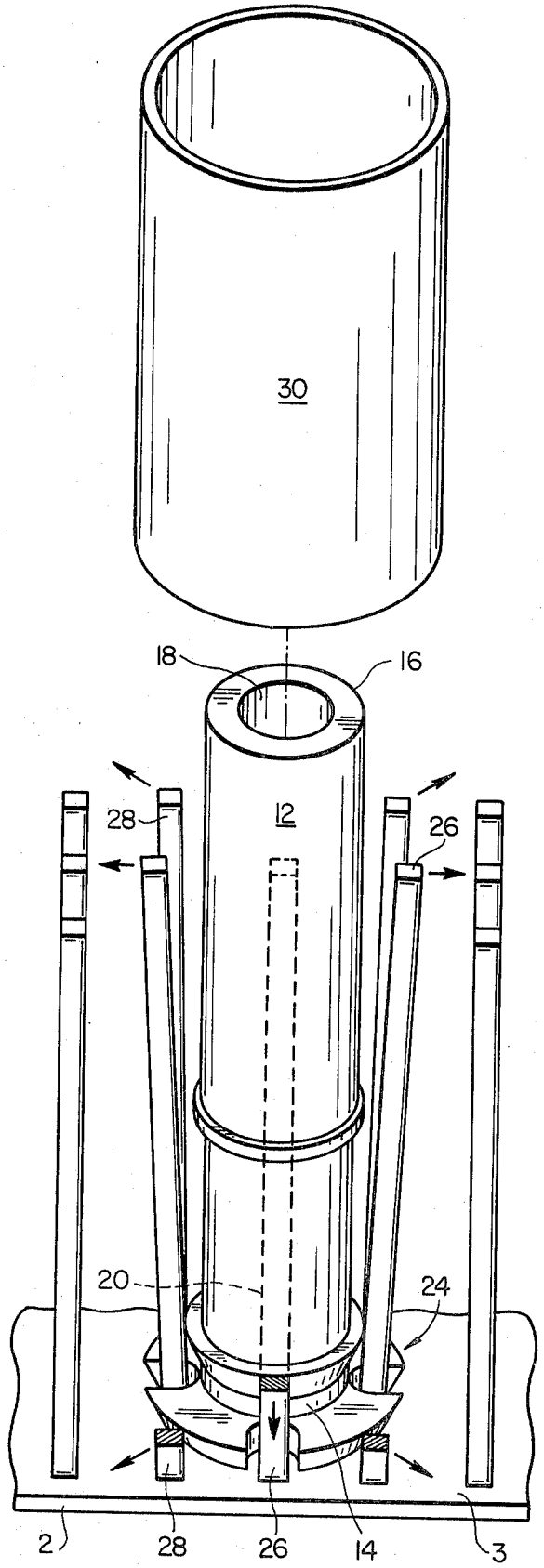
FIG. 1 is an exploded perspective view of the solderless connector device in accordance with this invention prior to attachment of the clamping means.

Referring to the drawings wherein like reference characters designate like or corresponding parts throughout the several views and referring particularly to FIG. 1, there is shown the connector device generally indicated by the numeral 10 in accordance with this invention.

The device is designed to engage pins arranged in a grid-like symetrical pattern on a printed wiring board (hereinafter P.W. board). The P.W. board includes a predetermined number of center pins with a symetrical arrangement of surrounding pins about each center pin. As will be explained more fully hereinafter, particularly with reference to FIG. 2, the device may be used to connect a coaxial cable or other shielded cable or other round cable to a P.W. board.

With particular reference to FIG. 1, there is seen the device which includes a turret like body 12 having a first end generally denoted by the numeral 14, a second end 16, and an opening 18 extending from the first end through the second end. The device may be inserted, as illustrated, onto a P.W. board 2 by engaging the first end opening 18 with a center pin such as at 20. The opening surrounds and isolates center pin 20 preventing center pin contact with the body. As will explained more fully hereinafter, it may be useful for isolation purposes to include an isolation means 22 around the center pin 20 to prevent such contact (See FIG. 2).

The first end includes an annular pins engagement means generally denoted by the numeral 24. As illustrated by the arrows in FIG. 1, the annular engagement means 24 spreads apart the surrounding pins 26 and 28. As will be more fully appreciated hereinafter, the engagement means creates and maintains a gas-tight intimate seal between the surrounding pins 26 and 28 while fiercely gripping the surrounding pins, discouraging removal of the body 12 from the P.W. board 2.

Figure 2:
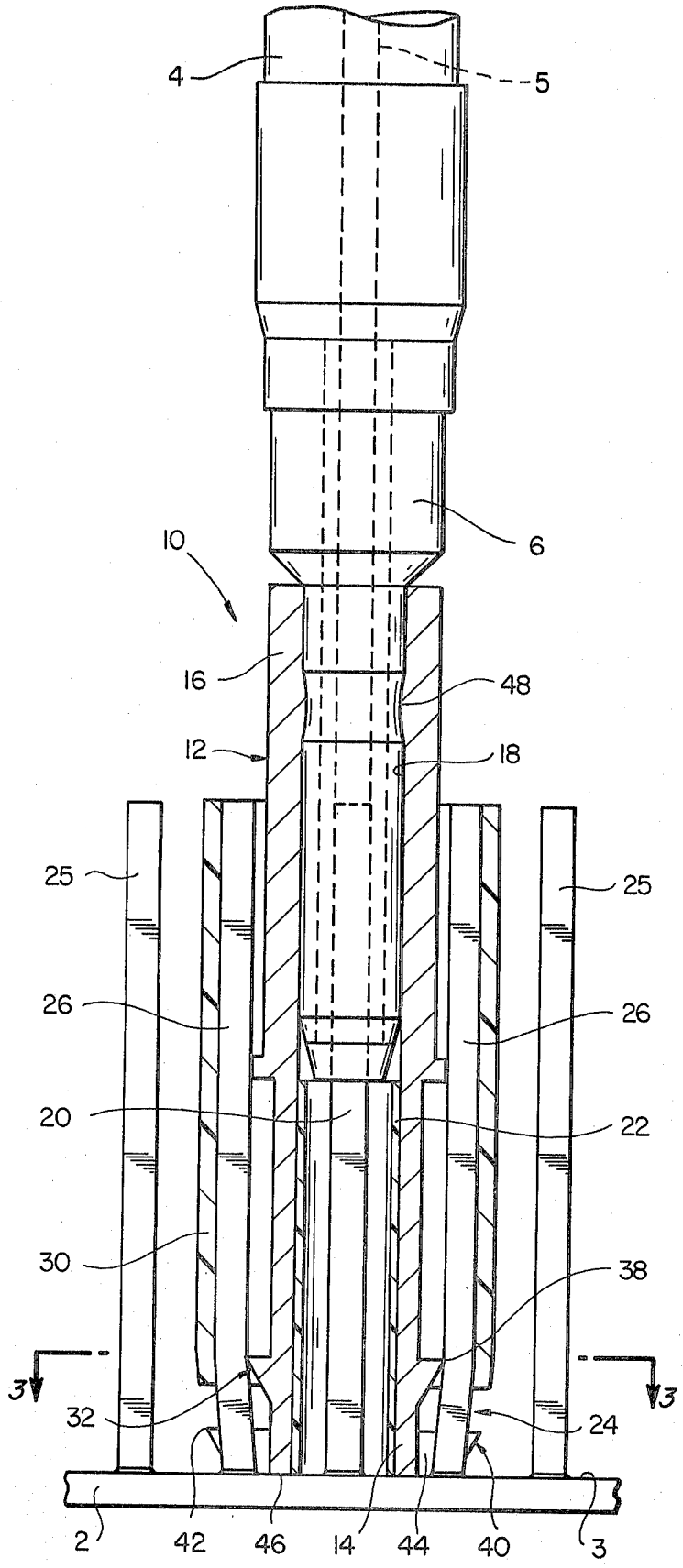
FIG. 2 is a cross-sectional view of the device in accordance with this invention with the clamping means attached and hooked up to a P.W. board and coaxial cable.

When the clamping means 30 is secured about the surrounding pins 26 and 28 (See FIG. 3), the pins are urged back to their normal pre-spread position, thereby further encouraging and maintaining a gas-tight intimate seal between the surrounding pins and the body as well as fiercely gripping the surrounding pins and further discouraging removal of the body 12 from the P.W. board 2. In the preferred embodiment, the clamping means 30 comprises a sleeve as illustrated in FIGS. 1 and 2. Further, a heat-shrinkable sleeve which would further urge and draw the pins in closer relation to the body is preferred.

Figure 3:
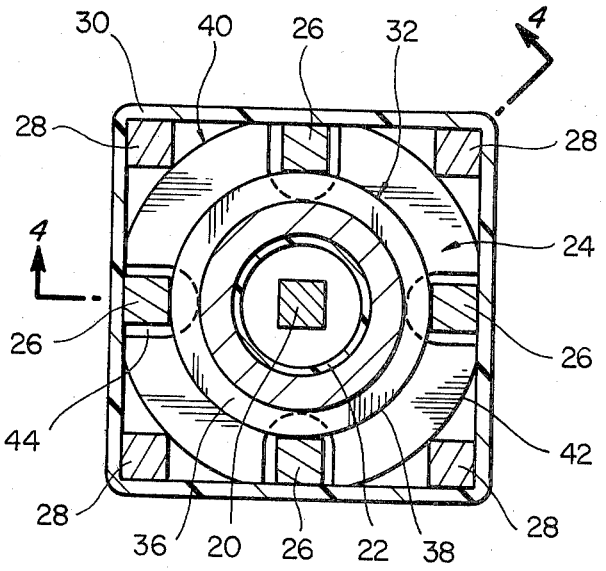
FIG. 3 is a cross-sectional view of the device taken along lines 3—3 of FIG. 2.

As can be seen clearly in FIG. 3, the center pin 20 is isolated and surrounded by the body and does not contact the body while the surrounding pins 26 and 28 are forced into contact with the body through the engagement means 24.

Figure 4:
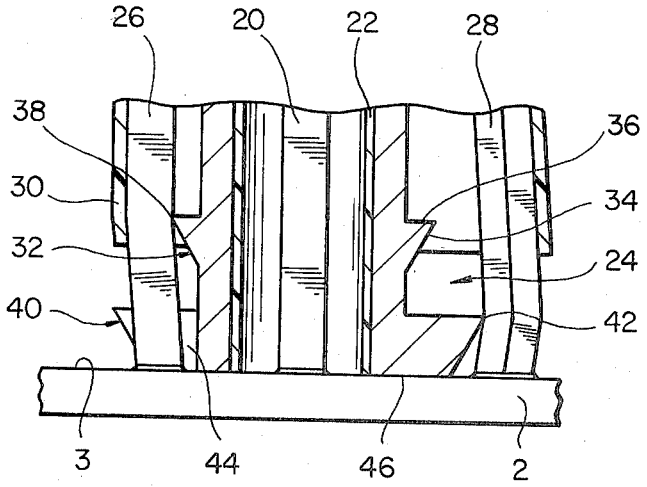
FIG. 4 is a cross-sectional view taken along lines 4—4 of FIG. 3 showing one embodiment of the engagement means in relation to the surrounding pins.

The engagement means 24 includes at least one annular ring 32. As can be seen more clearly in FIG. 4, annular ring 32 terminates at a beveled outer edge 34. In combination with the top face 36 of the annular ring 32, the beveled edge defines an annular barb 38. As can be seen in FIG. 4, the annular barb 38 displaces the surface of the surrounding pin 26.

As is normal in a grid, and as can be seen in FIG. 3, there are two sets of surrounding pins, an inner set 26, and an outer set 28. The engagement means may further include in the preferred embodiment a second larger diameter annular ring 40 which similarly terminates at a beveled outer edge, which defines an annular barb 42 for displacing the surface of the outer set of pins 28.

The second annular ring should include a plurality of symetrically spaced apart notches for accomodating the inner set of surrounding pins 26 such that when the connector is on the P.W. board the surrounding pins 26 are in registry with the notches 44 as illustrated in the Figures and especially FIG. 3.

Additionally, the preferred embodiment of the connector 10 includes the engagement means 24 having a second annular ring 40 at the terminus of the first end 14. In said case, the engagement means includes a bottom face 46 as seen in FIGS. 2 and 4 which is flush with the P.W. board top surface 3 for maintaining contact therewith. The importance of the flush contact of the body with the P.W. board will be appreciated more fully with the discussion of FIG. 2 as hereinafter.

It will of course, be appreciated that further surface displacement is encouraged when the engagement means 24 is made of a harder material than the surrounding pins 26 and 28. Applicant has found that heat-treated beryllium copper is especially useful for this purpose.

With particular reference to FIG. 2, there is shown the connector device 10 being used for the particular application of a coaxial cable or shielded cable or other round cable 4 being connected to a flat P.W. board 2 through a coaxial cable connector 6 and the connector device 10 in accordance with this invention.

As will be appreciated by those skilled in the art, when it is desirable to connect a shielded cable to a P.W. board, it is imperative to maintain the shielding effect of the cable through the connector device 6 and a connection means 10. Applicant's invention accomplishes this object by isolating the signal pin of the P.W. board such as 20 at opening 18. Further isolation may be provided by electrically insulated isolation means such as 22. The isolation means may comprise a dielectric sleeve or other like material which will electrically insulate the signal pin from the body.

The coaxial cable is terminated at a connector such as 6 wherein the shielding is connected to the outside of the connector and contacts the body 12. The signal transmitting element of the coaxial cable 5 extends through the connector 6 and into applicant's connector device 10, until reaching the signal pin 20, as illustrated. The shielding effect is maintained through the P.W. board by connection of the device through the engagement means 24 to shielding pins 26 and 28. Preferably the bottom face 46 of the connector device 10 is flush with the P.W. board top surface 3 so that frequencies from other signal pins 25 do not find a sneak path across the P.W. board and through signal pin 20 as illustrated in FIG. 2. The larger the mass of the second annular ring 40, the less likely the body 12 will be lifted off the face of the P.W. board 2.

An internal detent 48 in body 12 may be provided to maintain contact of the connector 6 with the body 12 and the signal element 5 with the signal pin 20.

While the instant invention has been described by reference to what is believed to be the most practical embodiments, it is understood that the invention may embody other specific forms not departing from the spirit of the central characteristics of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

I claim:

1. A solderless connector device for engaging pins arranged in a grid on P.W. board, the P.W. board having a center pin and an inner set and an outer set of surrounding pins, said sets being arranged symmetrically about the center pin, the device comprising:

a turret-like body having a first end and a second end and an opening extending through the first end to the second end, the opening in the first end configured for surrounding and isolating a center pin, the first end including an annular pins engagement means for spreading, gripping and creating a gas-tight seal with the surrounding pins, said engagement means comprising:

a rigid ring terminating at a sharply beveled outer edge defining an annular barb for displacing the surface of an inner set of surrounding pins, and:

a second, larger diameter ring having a plurality of symmetrically arranged notches which correspond to the symmetrical arrangement of an inner set of surrounding pins and are adapted for registry with the inner set of surrounding pins, said second, larger diameter ring terminating at a sharply beveled outer edge defining an annular barb for displacing the surface of an outer set of surrounding pins.

2. The device as set forth in claim 1 wherein the second larger ring is located at the terminus of the first end, and wherein the second ring includes a flat bottomed face for flush, continuous contact of the body with a P.W. board.

3. The device set forth in claim 2 wherein the engagement means is made from a material which is harder than surrounding pins, thereby allowing increased surface displacement of such surrounding pins with the engagement means.

4. The device as set forth in claim 3 wherein the engagement means is made from heat-treated beryllium copper.

* * * * *